US005554075A

United States Patent [19]

Glazer

[11] Patent Number: 5,554,075

[45] Date of Patent: Sep. 10, 1996

[54] POOL CUE ALIGNMENT DEVICE

[76] Inventor: Gabriel I. Glazer, 7118 N. 6th Ave., Phoenix, Ariz. 85016

[21] Appl. No.: 589,408

[22] Filed: Jan. 22, 1996

[51] Int. Cl.[6] ..... A63D 15/08

[52] U.S. Cl. ..... 473/2; 473/46

[58] Field of Search ..... 473/2, 44, 46

[56] References Cited

U.S. PATENT DOCUMENTS

| | | | |
|---|---|---|---|
| 4,688,796 | 8/1987 | Wright | 473/2 |
| 5,181,718 | 1/1993 | Valentine | 473/2 |

FOREIGN PATENT DOCUMENTS

| | | | |
|---|---|---|---|
| 2276825 | 10/1994 | United Kingdom | 473/2 |

*Primary Examiner*—Mark S. Graham
*Attorney, Agent, or Firm*—Cahill, Sutton & Thomas, P.L.C.

[57] ABSTRACT

A pool cue alignment device for pocket billiards includes a laser mounted to the shaft of the pool cue. The laser beam is initially directed generally parallel to the pool cue, and at least a portion of such beam strikes the cue ball. A section of a mirror or glass, serving as a beam deflector, is mounted to the pool cue between the laser and the tip of the pool cue for diverting a portion of the laser beam at an acute angle upwardly away from the cue stick. The deflected portion of the laser beam passes over the cue ball generally parallel to the pool table for striking either a numbered object ball or a reflector disposed adjacent a cushion.

4 Claims, 2 Drawing Sheets

POOL CUE ALIGNMENT DEVICE

BACKGROUND OF THE INVENTION

1. Field of the Invention

The present invention relates generally to pool cue sticks used in playing pocket billiards, and more particularly, to a training device for use in conjunction with a pool cue stick for assisting a player in learning to align pool shots.

2. Description of the Relevant Art

Pocket billiards is a recreational game enjoyed by many persons, both young and old. Pocket billiard tables are often found in the home for the entertainment of children and adults. However, beginners sometimes have difficulty learning how to hold the cue stick to produce a desired shot. For example, beginners often find it difficult to align the cue stick at the correct angle to drive the cue ball along an intended path in order to hit a distant numbered object ball located on the opposite side of the table. On other occasions, beginners may succeed in hitting the intended object ball, but the cue ball strikes the object ball at the wrong point, so the object ball is not directed toward the intended pocket. On still other occasions, a player may decide to "bank" the cue ball off of one of the elastic cushions before striking the intended object ball, but the player is unable to visualize the path that will be followed by the cue ball after bouncing off of the elastic cushion.

The present applicant is aware of a cue stick guidance device which has been offered for sale by Sharper Image, and which uses a laser device mounted to a cue stick for projecting a light beam generally along the axis of the cue stick. One disadvantage of such a guidance device is that, in order to project the beam parallel to the table, the cue stick must also be held parallel to the table. However, most players hold the cue stick at a slight downward angle when actually taking a shot, such that the beam is focussed upon the cue ball and nowhere else. Assuming that the tip of the cue stick is directed at the cue ball, as is the case when a player is normally preparing to make a shot, the beam is intercepted by the cue ball. Thus, when using such Sharper Image device, the laser beam provides no useful information to the player as the player prepares to strike the cue ball.

Applicant is also aware of an episode of a syndicated television series known as "Quantum Leap" wherein actor Scott Bakula portrays an elderly pool player. Within such episode, the desired path of various pool shots is indicated by a light beam, visible only to the actor and television viewers, but not visible to the actor's opponent. The light beam is displayed using trick photography, and the source of the light beam is not in any way coupled to the cue stick.

Accordingly, it is an object of the present invention to provide a pool cue alignment device which assists a player in learning to align the cue stick at the correct angle to drive the cue ball along an intended path in order to hit a distant numbered object ball located on the opposite side of the table.

It is another object of the present invention to provide a pool cue alignment device which allows a player to determine the point of the periphery of an object ball that will be struck by the cue ball, thereby assisting the player to direct the object ball toward the intended pocket.

Still another object of the present invention is to provide such a guidance device which allows a player to hold the cue stick at an angle, relative to the table, that would typically be used when striking the cue ball, and to direct the tip of the cue stick toward the cue ball, while still seeing a point of light indicating the direction in which the cue ball will be driven.

A still further object of the present invention is to permit a player to see the point at which a cue ball or object ball will be directed after bouncing off of an elastic cushion on the table.

Yet another object of the present invention is to provide such a guidance device which is relatively inexpensive, easy to manufacture, and easy to install upon a conventional cue stick.

These and other objects of the present invention will become more apparent to those skilled in the art as the description of the present invention proceeds.

SUMMARY OF THE INVENTION

Briefly described, and in accordance with a preferred embodiment thereof, the present invention relates to a pool cue alignment device for assisting a user in learning to line up a pool shot on a pocket billiards table, the device including a cue stick extending longitudinally between a handle end and an opposing tip end. The device includes a laser for directing a source beam of laser light, as well as a fastening mechanism for fastening the laser to the cue stick in order to direct the source beam along a path extending generally parallel to the longitudinal axis of the cue stick, and generally toward the tip end of the cue stick.

The device further includes a beam deflector for receiving at least a portion of the source beam and for generating a deflected beam, the deflected beam being directed at an acute angle from the path of the source beam. The beam deflector is fastened to the cue stick between the laser and the tip end of the cue stick. The beam deflector is fastened to the cue stick sufficiently spaced from the tip end of the cue stick to direct the deflected beam over the top of a cue ball when the tip end of the cue stick is pointed toward the cue ball.

In the preferred embodiment, the beam deflector allows at least a portion of the source beam to pass undeflected beyond the beam deflector for striking the cue ball when the tip end of the cue stick is directed toward the cue ball, while still allowing the deflected beam to pass over the cue ball to indicate the path along which the cue ball will be driven.

The beam deflector may consist, for example, of a mirror, prism or refractive glass, which intercepts all, or at least a portion, of the source beam to create the deflected beam.

The pool cue alignment device of the present invention may also include a reflector positioned proximate an elastic cushion of the pocket billiards table for assisting in the alignment of bank shots. The reflector is positioned generally in the vicinity of the elastic cushion against which cue ball or target ball will be banked. The reflector receives the deflected beam and reflects the deflected beam away from the elastic cushion, thereby indicating the path to be taken by the cue ball or target ball after the same bounces off of the elastic cushion.

DETAILED DESCRIPTION OF THE PREFERRED EMBODIMENT

Figure 1:
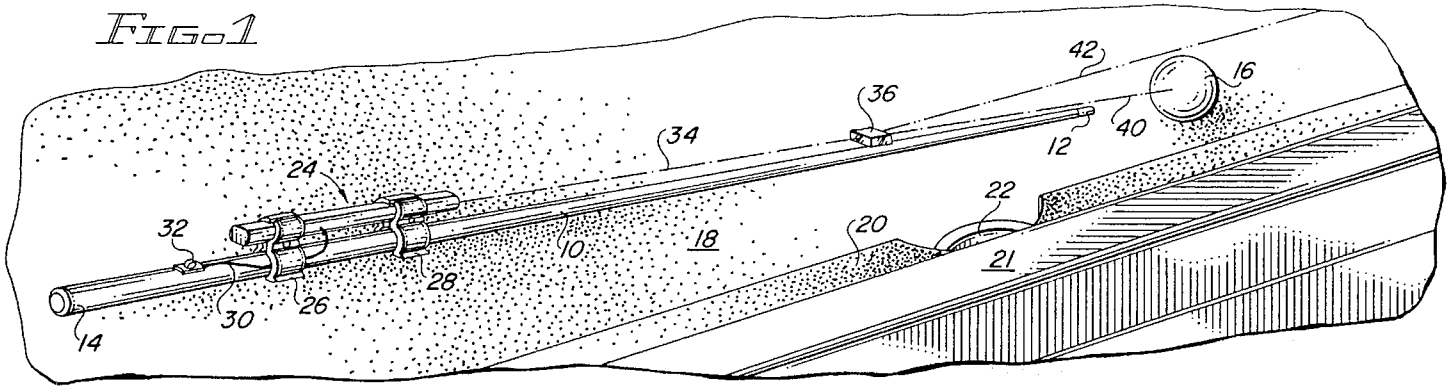
FIG. 1 is a perspective view of a pool cue stick incorporating an alignment training device constructed in accordance with a preferred embodiment of the present invention.

As shown in FIG. 1, cue stick 10 includes a tip 12 at one end thereof and a handle 14 at its opposing end. Tip 12 is used to strike cue ball 16 when making a shot. Cue ball 16 rests upon a conventional billiards table 18 having a side pocket 22, a side bumper 20, and supporting side frame member 21.

In FIG. 1, laser pointer 24 is secured to cue stick 10 generally near end 14 by a pair of brackets 26 and 28, each of which extends about cue stick 10. Brackets 26 and 28 are described in greater detail below in conjunction with FIG. 2. Laser pointer 24 has a longitudinal axis which extends generally parallel to the longitudinal axis of cue stick 10.

Laser pointer 24 is preferably a diode-type laser pointer that emits a thin red-colored beam; such laser pointers are commercially available from Laserpro of Scottsdale, Ariz. under the model name "ULTRABRITE", Model No. LDP-300UB. This laser pointer is classified as a Class IIIa laser and is rated as producing under 5.0 mW of power. Laser pointer 24 emits a source light beam indicated by dashed line 34 in FIG. 1, which light beam extends generally along cue stick 10 toward tip 12 thereof.

Figure 3:
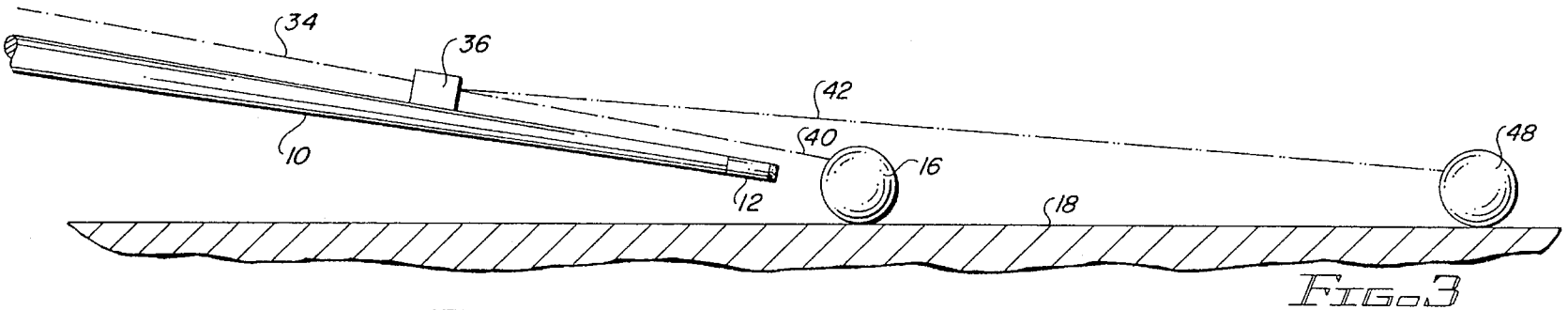
FIG. 3 is a side view of the cue stick shown in FIG. 1 in use, and illustrating the manner in which the deflected beam passes over the cue ball to strike the object ball.

Referring to FIGS. 1 and 3, laser beam 34 is intercepted by a beam deflector 36 which, in the preferred embodiment, is a square-shaped fragment of a glass mirror. Mirror fragment 36 is secured to cue stick 10 by craft glue. Source beam 34 enters mirror fragment 36 along the front side thereof. A portion of incident beam 34 passes through mirror fragment 36 undeflected as light beam 40 along the same axis as incident beam 34 and strikes cue ball 16. However, mirror fragment 36 causes a portion of the incident beam 34 to diverge away from cue stick 10 at an acute angle as deflected beam 42. It is not clear whether the reflective surface of mirror fragment 36 plays a role in generating the deflected beam, or whether the deflected beam arise purely from the refractive properties of the glass; it is enough to point out that when the incident beam is directed toward the forward-most edge of the mirror fragment, it is possible to create both a deflected beam 42 as well as the undeflected beam 40.

As shown in FIGS. 1 and 3, deflected beam 42 passes over cue ball 16 to indicate the path along which cue ball 16 will take when struck by cue stick 10. As indicated in FIG. 3, deflected beam 42 may be directed toward object ball 48. Deflected beam 42 will illuminate the surface of object ball 48 at the point at which cue ball 16 will strike it. If the point illuminated on object ball 48 is not the point which the player desires to strike, then the player shifts the position of handle end 14 of cue stick 10 until deflected beam 42 illuminates the desired point of contact on the surface of object ball 48.

Figure 2:
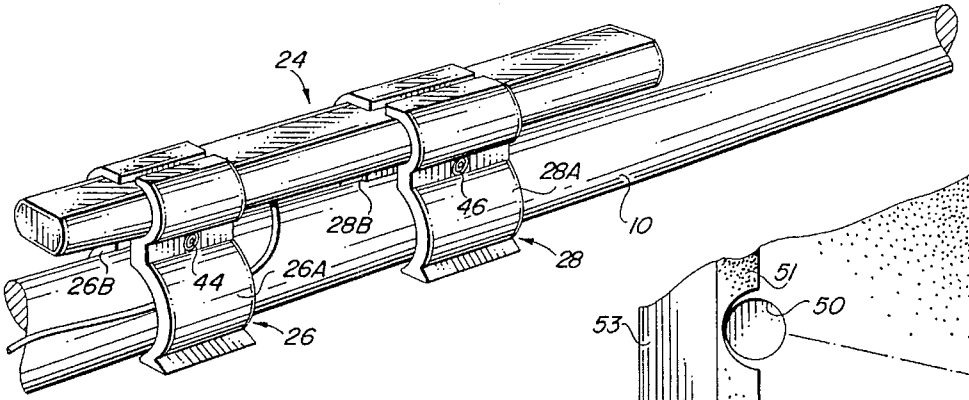
FIG. 2 is an enlarged partial perspective view of the cue stick shown in FIG. 1 and showing the manner by which a laser pointing device is secured to the cue stick.

Referring now to FIG. 2, brackets 26 and 28, used to secure laser pointer 24 to cue stick 10, are shown in greater detail. Bracket 26 is formed of two halves 26A and 26B; each such half has a semicircular lower portion that extends about cue stick 10. Each of halves 26A and 26B also includes an upper claw that extends about the housing of laser pointer 24. Halves 26A and 26B are secured together by an Allen-head screw 44. Bracket 28 is similarly composed of two halves 28A and 28B clamped together by Allen-head screw 46. Brackets 26 and 28 may be provided by conventional rifle scope mounting brackets of the type commercially available from Scope Mount Corporation of Inkster, Mich. under the trademark "WIDEVIEW" and sold as Model WSM.22.

Figure 4:
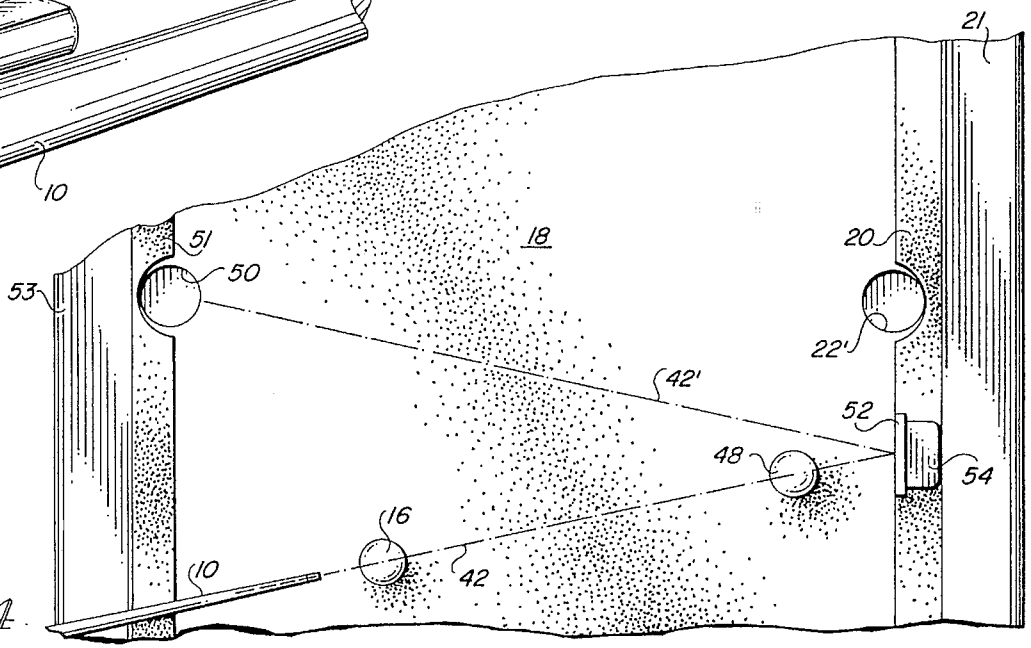
FIG. 4 is a top view of a pool table illustrating the manner in which the present invention may be used in conjunction with a bumper reflector to indicate the path to be taken by an object ball and/or cue ball after being banked off of a bumper.
Figure 5:
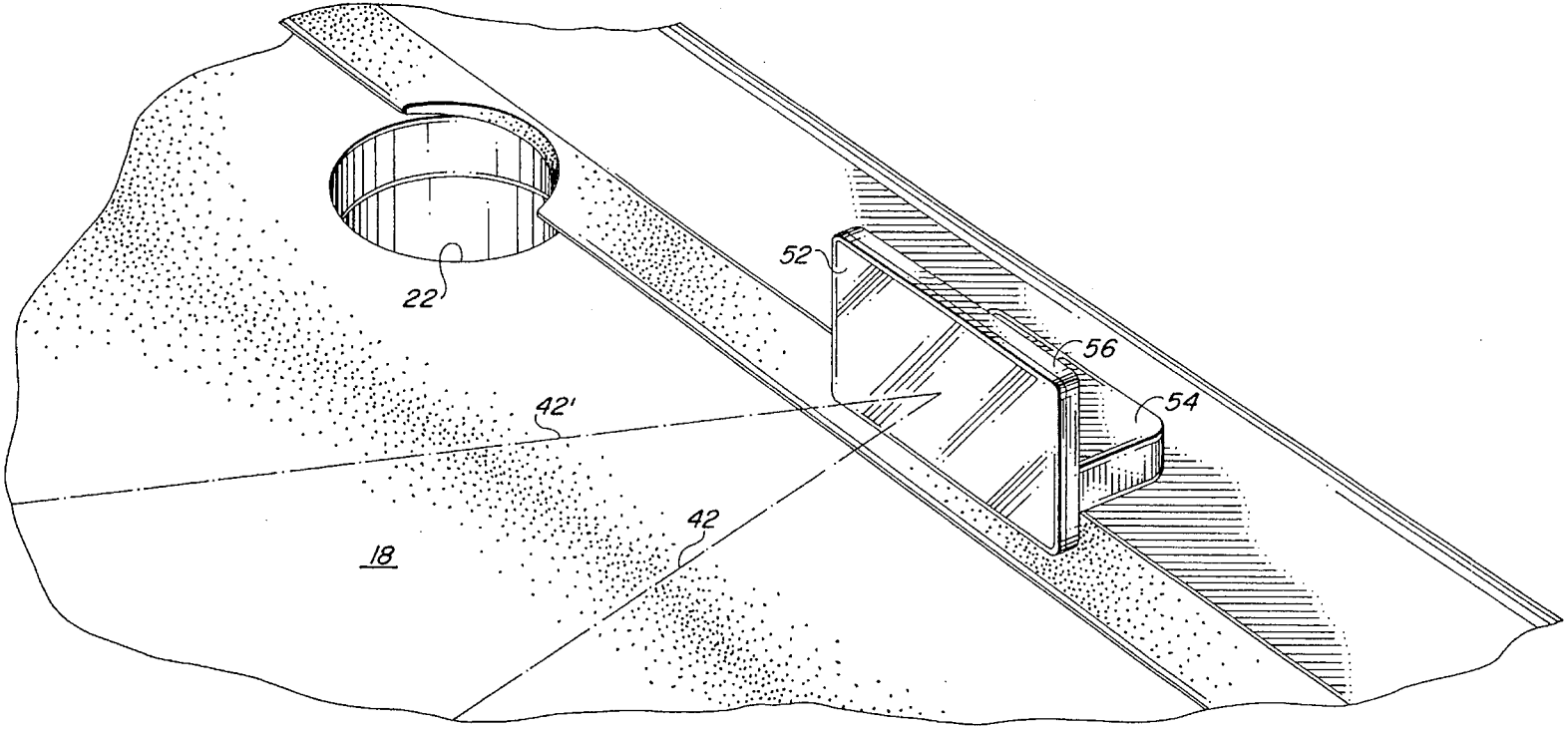
FIG. 5 is a perspective view of the bumper reflector shown in FIG. 4.

FIGS. 4 and 5 illustrate the manner by which the present invention may be used to indicate the path to be taken by a cue ball or object ball that is to be banked off of a cushion of the pool table. In the top view shown in FIG. 4, cue ball 16 will be used to drive object ball 48 against side cushion 20 toward opposing side pocket 50. A mirror 52 is placed upon side cushion 22 proximate the point at which object ball 48 will be banked off of such cushion. Mirror 52 is positioned to extend substantially vertical and parallel to cushion 20. Cue stick 10 is directed toward cue ball 16, allowing deflected beam 42 to pass over both cue ball 16 and object ball 48, striking mirror 52, and causing deflected beam 42 to be reflected along path 42' toward opposing side cushion 51; a red dot will be formed on side cushion 51 at the point toward which the object ball 48 can be expected to travel.

Those skilled in the art will now appreciate that a pool cue alignment device has been described which assists a player in learning to align the cue stick at the correct angle to drive the cue ball along an intended path in order to hit a desired numbered object ball. The described device allows a player to easily determine the point on the periphery of an object ball that will be struck by the cue ball, thereby assisting the player in directing the object ball toward the intended pocket. The present device allows the cue stick to be held at the typical angle, relative to the table, that would ordinarily be used when preparing to strike the cue ball, while still forming a point of light beyond the cue ball to indicate the direction in which the cue ball will be driven. The addition of the banking reflector allows a player to see the point at which a cue ball or object ball will be directed after bouncing off of an elastic cushion on the table. Moreover, the described guidance device is relatively inexpensive, easy to manufacture, and easy to install upon a conventional cue stick.

While the present invention has been described with respect to a preferred embodiment thereof, such description is for illustrative purposes only and should not be construed as limiting the scope or breadth of the invention. Various changes and modifications to the described embodiment may be made by those skilled in the art without departing from the true spirit and scope of the invention as defined by the appended claims.

I claim:

1. A pool cue alignment device for assisting a user in lining up a pool shot on a pocket billiards table, said device comprising in combination:

a. a cue stick having a longitudinal axis, and having a handle end and an opposing tip end;

b. a laser for directing a source beam of laser light;

c. fastening means for fastening the laser to the cue stick for directing the source beam along a path extending generally parallel to the longitudinal axis of the cue stick, and generally toward the tip end of the cue stick;

d. a beam deflector for receiving at least a portion of the source beam and generating a deflected beam, the deflected beam being directed at an acute angle from the path of the source beam, said beam deflector being fastened to the cue stick between the fastening means and the tip end of the cue stick, the beam deflector being sufficiently spaced from the tip end of the cue stick to direct the deflected beam over the top of a cue ball when the tip end of the cue stick is pointed toward the cue ball.

2. The alignment device recited by claim 1 wherein the beam deflector allows at least a portion of the source beam to pass undeflected beyond the beam deflector for striking a cue ball when the cue stick is directed toward the cue ball.

3. The alignment device recited by claim 1 wherein the pocket billiards table includes elastic cushions, and wherein the alignment device includes a reflector disposed proximate an elastic cushion for reflecting the deflected beam off of the elastic cushion.

4. The alignment device recited by claim 1 wherein the beam deflector is a mirror.

* * * * *